US005718020A

United States Patent [19]

Harrison et al.

[11] Patent Number: 5,718,020

[45] Date of Patent: Feb. 17, 1998

[54] SEAT BELT BUCKLE

[75] Inventors: Mark John Harrison, Belfast; Michael John Jackson, Co Antrim; Kotaro Kitai, Holywood, all of United Kingdom

[73] Assignee: European Components Co. Limited, Belfast, United Kingdom

[21] Appl. No.: 668,934

[22] Filed: Jun. 24, 1996

[30] Foreign Application Priority Data

Jun. 28, 1995 [GB] United Kingdom ..... 9513160

[51] Int. Cl.[6] ..... A44B 11/26

[52] U.S. Cl. ..... 24/633; 24/641

[58] Field of Search ..... 411/511, 516; 24/573.1, 633, 640, 641, 642, 645

[56] References Cited

U.S. PATENT DOCUMENTS

| | | | |
|---|---|---|---|
| 3,121,289 | 2/1964 | Eyolfson | 411/511 X |
| 4,899,424 | 2/1990 | Barnes et al. | 24/641 |
| 5,123,147 | 6/1992 | Blair | 24/633 X |
| 5,210,915 | 5/1993 | Clarke | 24/641 |
| 5,271,129 | 12/1993 | Clarke et al. | 24/641 |

FOREIGN PATENT DOCUMENTS

| | | |
|---|---|---|
| 0 341 840 | 11/1989 | European Pat. Off. . |
| 0 452 464 | 2/1994 | European Pat. Off. . |
| 2 289 308 | 11/1995 | United Kingdom . |
| 91/06231 | 5/1991 | WIPO . |

*Primary Examiner*—James R. Brittain
*Attorney, Agent, or Firm*—Foley & Lardner

[57] ABSTRACT

A buckle for a seat belt of a motor vehicle includes a lockbar 18 engagable in an aperture 26 in a latch plate 24, which is inserted into the buckle. A slider 16 connected with the lockbar 18 is retained under a lockpin 12 to prevent the lockbar 18 from disengaging the aperture 26 in the latch plate 24, except when a release button 20 is depressed. The surface of the lockpin 12 confronting the slider 16, when the lockbar 18 is engaged in an aperture 26 in a latch plate 24, is provided with one or more protuberances 28 such that when under high load the lockpin 12 becomes embedded in the slider 16 to prevent the slider 16, from sliding with respect to the lockpin 12 and inadvertently releasing the latch plate 24 from the buckle.

13 Claims, 2 Drawing Sheets

SEAT BELT BUCKLE

BACKGROUND OF THE INVENTION

The present invention relates to a buckle for seat belts in motor vehicles.

Seat belt buckles are well known in which a latch plate attached to a seat belt cad be inserted into a slot in the buckle. The seat belt and buckle are secured to the vehicle bodywork. A lockbar in the buckle releasably engages an aperture in the latch plate to prevent the latch plate coming out of the buckle, in particular in a motor accident, thereby restraining the occupant of the seat. Pressing on a release button of the buckle disengages the lockbar from the latch plate and enables the latch plate to be released from the buckle and the seat belt to be removed from the occupant.

A conventional buckle comprises a rigid frame including a base, upstanding side walls adapted to guide the latch plate longitudinally of the frame, a lockpin extending transversely of the frame between the side walls, said lockpin being spaced above the base, a locking lever pivotally mounted on the frame and pivotal between a lower latched position and an upper unlatched position, said locking lever carrying a downward projecting lockbar engagable in said aperture in the latch plate to retain the latch plate in place, a slider is slidable longitudinally of the locking lever between a first position in which it is located under said lockpin, to retain the locking lever in the lower latched position and a second position in which it allows said locking lever to pivot to its upper unlatched position and a slider spring urges the slider toward its first position.

A release button is provided to push the slider to its second position, the slider being resiliently urged by the slider spring against the rear of the lockpin to retain the locking lever in its upper unlatched position. On inserting the latch plate into the slot of the buckle, the slider is released so that the slider spring may urge it to its first position under the lockpin and the locking lever may pivot to its lower latched position engaging the aperture in the latch plate with the lockbar.

When a force is exerted on the latch plate which tends to withdraw it from the slot, this tries to pivot the lockbar and locking lever upward, but this motion is prevented by the slider which is positioned between the locking lever and the lockpin. The resultant component of force is therefore transmitted to the lockpin. However, when the latch plate is subjected to an extreme force, such as may occur in a severe accident, the force between the slider and lockpin may cause the slider to slip out from underneath the lockpin thereby permitting the locking lever to pivot and the lockbar to become disengaged from the aperture in the latch plate. Consequently the buckle inadvertently releases the latch plate and the occupant of the seat is no longer restrained.

SUMMARY OF THE INVENTION

One of the objects of the invention is provided a buckle for a seat belt of a motor vehicle that alleviates the problem of the slider slipping from under the lockpin under severe load conditions, but without hindering the function of the buckle under normal conditions and also after the severe load has been removed.

This objective is achieved by a buckle having a frame including a base with upstanding side walls and a lockpin extending between the side walls. A lockbar in the buckle is engagable in an aperture in a latch plate associated with the seat belt. A slider is connected with the lockbar. The slider being retained under the lockpin when the lockbar is engaged in the latch plate aperture.

The buckle is provided with a release button for releasing the slider from the lockpin and thus releasing the lockbar from engagement with the aperture in the latch plate. A lower surface of the lockpin confronting the slider is provided with one or more protuberances that can each deform the material of the slider.

BRIEF DESCRIPTION OF THE DRAWINGS

The accompanying drawings, which are incorporated in and constitute a part of the specification, illustrate a presently preferred embodiment of the invention, and, together with the general description given above and the detailed description of the preferred embodiment given below, serve to explain the principles of the invention.

DETAILED DESCRIPTION OF PREFERRED EMBODIMENT

Figure 1:
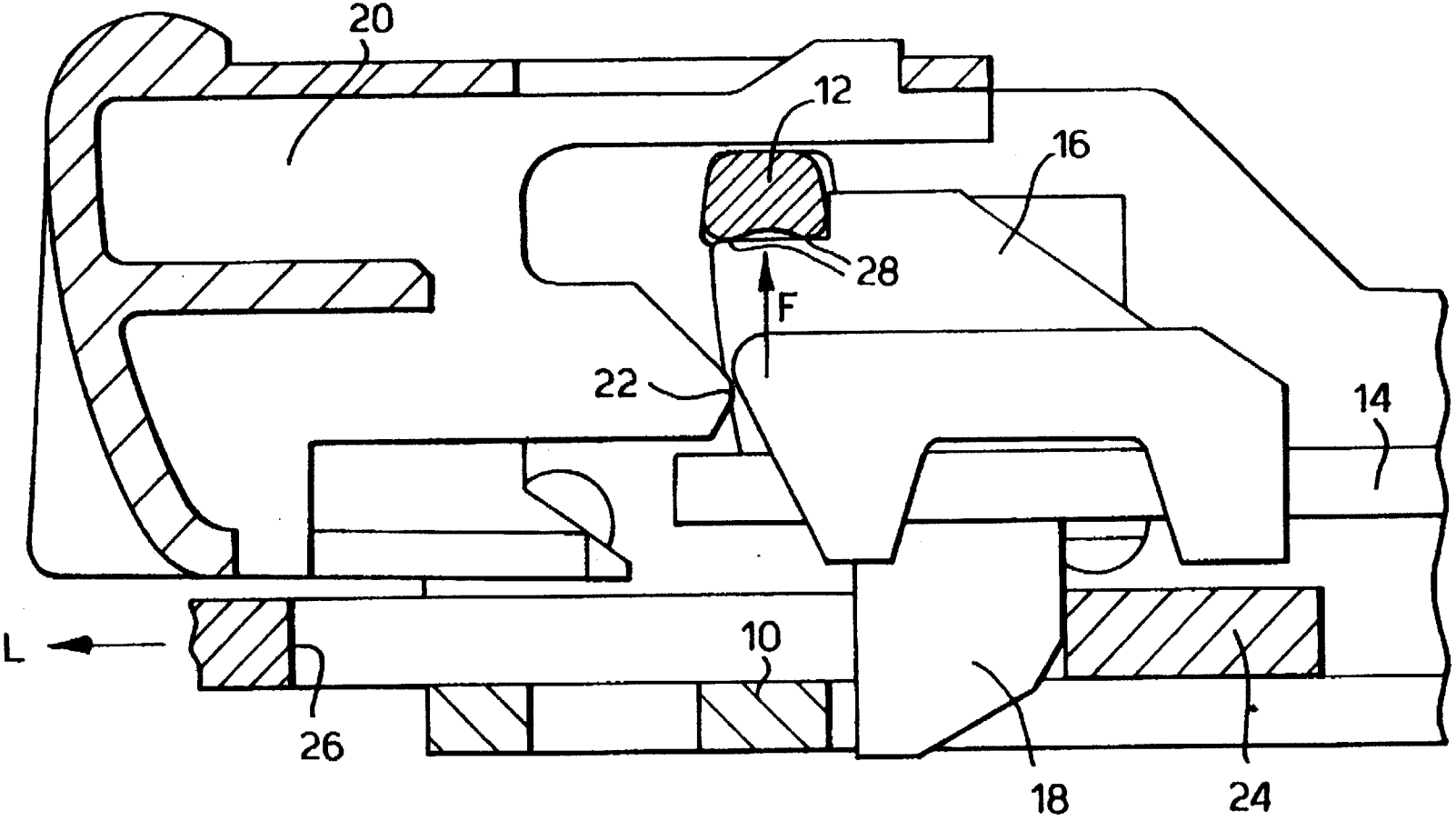
FIG. 1 shows in section a portion of a buckle according to the invention with a latch plate inserted.

Referring to FIG. 1 which illustrates a buckle similar to that disclosed in EP-0452464B, which document is hereby incorporated by reference. The buckle of the invention consists of a channel section frame 10 having side walls which are joined by a lockpin 12. Pivotally mounted between the side walls is a locking lever 14 on which is slidably mounted a plastics material slider 16, which is urged to the left by a slider spring (not shown). The locking lever 14 carries a downwardly extending lockbar 18.

Also axially slideable relative to the frame 10 is a release button 20, including an abutment 22 engagable with the slider 16, so that when the release button 20 is pushed to the right. The slider may be disengaged from under the lockpin 12, whereupon the lever 14 will pivot clockwise under the action of a spring (not shown). Between the lower surface of the release button 20 and a facing upper surface of a portion of a frame 10, there is found an elongate slot into which may be inserted a latch plate 24 having an aperture 26. The lockbar 18 is shown engaged in this aperture 26 and is normally retained in this position by the action of the lockpin 12 preventing movement of the lever 14. When the release button 20 is moved to the right, the lever 14 will pivot, thereby disengaging the lockbar 18 from the aperture 26, whereupon the latch plate 24 can either be removed by pulling on the belt, or more normally, the latch plate 24 is ejected by a spring loaded ejector (not shown).

Figure 2A:
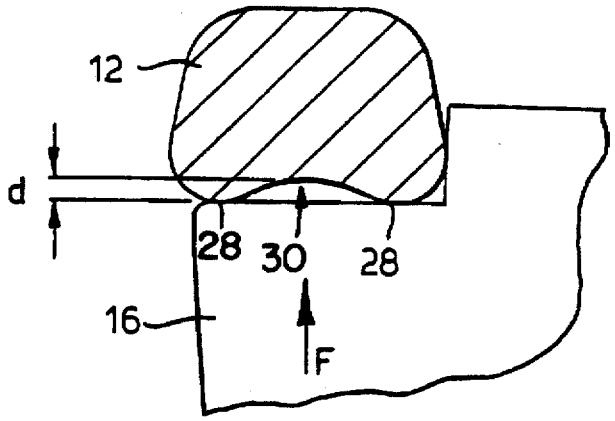
FIG. 2(*a*) to 2(*c*) illustrate the functioning of the lockpin and slider according to the invention.
Figure 2B:
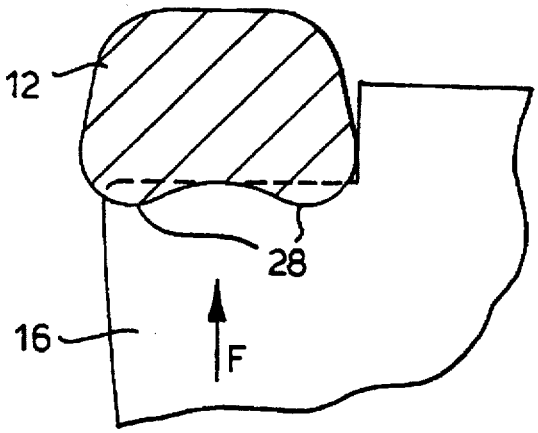
Figure 2C:
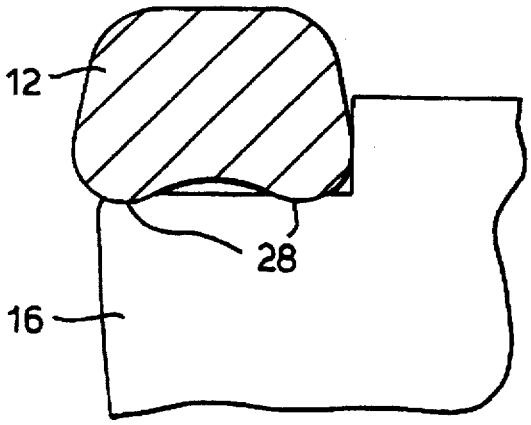

According to the invention, the lower surface of the lockpin 12 confronts the slider 16 and prevents the movement of the lever 14 and disengagement of the lockbar 18 from the aperture in the latch plate 24. The lockpin 12 is provided with one or more protuberances 28. When a force L is exerted on a latch plate 24 to tend to withdraw it from the buckle, a component of force F is also generated which urges the slider 16 toward the lockpin 12. The lockpin 12 is typically made, for example, from a relatively hard metal and the slider 16 is typically made, for example, of a plastics material. As shown in FIG. 2(*a*), the protuberances 28 reduce the area of contact between the lockpin 12 and the slider 16 so that for a given force between the two components the stress at the point of contact is greatly increased. When the force on the latch plate 24 exceeds a critical load, the protuberances 28 begin to embed themselves in the slider 16. As they do so, the area of contact increases to include adjacent slider engaging surface 30, thus reducing the stress on the surface of the slider.

The protuberances 28 lock into the deformed slider 16 as illustrated in FIG. 2(*b*) to prevent lateral slippage of the slider 16 on the surface of the lockpin 12 and the potential consequent inadvertent release of the buckle. As the load L on the latch plate 24 is reduced and the force F becomes zero, the slider 16 partially recovers to the original shape it had before undergoing elastic deformation, but there may still be some permanent deformation of the slider 16 caused by plastic deformation, see FIG. 2(*c*). The permanent deformation however has little or no effect on the normal release operation of the buckle by means of the release button 20.

The lockpin 12 with protuberances 28 may be fabricated by any of a number of methods, one such method being forming a recess in a conventional lockpin. In the embodiment illustrated here the protuberances comprise two ridges along the length of the lockpin, other configurations are of course possible including one or more ridges or for example bumps in the surface.

In one example of a seat belt buckle according to the invention, the critical load L pulling on the latch plate is 20 kN, but for different applications this load may of course have a different value such as 10, 15, 20 or 25 kN. Tests showed that with a 20 kN load, the force F pressing the slider against the lockpin was 1.3 kN. The material of the slider has a yield stress of 100 MPa. This indicates that in order for deformation of the slider to occur at this load, the area of contact must be less than 13 $mm^2$. The area of contact of a known prior lockpin on the slider is 13.4 $mm^2$.

It is preferred that the lockpin 12 embeds itself in the slider by at least 0.2 mm, and in the preferred embodiment the distance d by which the protuberances project from the lockpin 12 is 0.3 mm.

Other embodiments of the invention will be apparent to those skilled in the art from consideration of the specification and practice of the invention disclosed herein. It is intended that the specification be considered as exemplary only, with the true scope and spirit of the invention being indicated by the following claims.

What is claimed is:

1. A buckle for a seat belt comprising:

a frame including a base and upstanding side walls;

a slider;

a lockpin extending between the side walls of the frame, with the lockpin having a surface effective to engage and retain the slider, the surface having at least one protuberance effective to deform a material of the slider, the at least one protuberance extending beyond an adjacent slider engaging surface of the lockpin; and a release button that releases the slider from engagement with the lockpin.

2. The buckle in claim 1, wherein the buckle is for a seat belt of a motor vehicle, the seat belt including an associated latch plate with an aperture.

3. The buckle of claim 1, wherein the slider is operatively connected to a lockbar.

4. The buckle of claim 3, wherein the lockbar is engagable with an aperture of a latch plate associated with the seat belt.

5. The buckle of claim 4, wherein the lower surface of the lockpin retains the slider when the lockbar engages the aperture of the latch plate.

6. The buckle of claim 5, wherein when the release button releases the slider from engagement with the lockpin, the lockbar releases from engagement with the aperture.

7. The buckle of claim 1, wherein the at least one protuberance comprises two ridges along a length of the lockpin.

8. The buckle of claim 1, wherein the at least one protuberance comprises a material with a hardness greater than the hardness of the material of the slider so that the at least one protuberance embeds itself into the slider when a force greater that a critical load is exerted on a latch plate that is inserted into the buckle, the force being in a direction opposite to the direction of insertion of the latch plate into the buckle.

9. A buckle for a seat belt of a motor vehicle, the seat belt including an associated latch plate, and the latch plate having an aperture therein, the buckle comprising a frame including a base and upstanding side walls, a lockpin extending between the side walls, a lower surface to the lockpin, a lockbar engagable in the aperture in the latch plate, a slider operatively connected with the lockbar, the lockpin being effective to retain the slider under the lockpin when the lockbar is engaged in the latch plate aperture, a release button for releasing the slider from the lockpin and thus releasing the lockbar from engagement with the aperture in the latch plate, wherein the lower surface of the lockpin confronts the slider with at least one protuberance on the lower surface extending below an adjacent slider engaging surface to the lockpin, whereby the at least one protuberance is effective under the pressure to deform the material of the slider.

10. A buckle according to claim 9, wherein the slider is made of a plastic material.

11. A buckle according to claim 9, wherein the at least one protuberance comprises two ridges along at least a portion of the length of the lockpin.

12. A buckle according to claim 11, wherein the two ridges run along substantially the entire length of the lockpin.

13. A buckle according to claim 9, wherein the at least one protuberance comprise a material harder than that of the slider, effective to embed itself into the slider when a force greater than a critical load is exerted on a latch plate inserted into the buckle, the force being in a direction opposite to the direction of insertion of the latch plate.

* * * * *